US006735795B1

(12) United States Patent
Lau

(10) Patent No.: US 6,735,795 B1
(45) Date of Patent: May 18, 2004

(54) ADULT-SIZED BED RETROFITTING SYSTEMS

(76) Inventor: Doris Man-yee Lau, 1219 Dell Dr., Monterey Park, CA (US) 91754

( * ) Notice: Subject to any disclaimer, the term of this patent is extended or adjusted under 35 U.S.C. 154(b) by 0 days.

(21) Appl. No.: 09/663,906

(22) Filed: Sep. 18, 2000

Related U.S. Application Data

(63) Continuation-in-part of application No. 09/241,958, filed on Feb. 2, 1999, now Pat. No. 6,134,726.

(51) Int. Cl.[7] ..... A47C 21/00
(52) U.S. Cl. ..... 5/93.1; 5/658; 5/503.1
(58) Field of Search ..... 5/93.1, 2.1, 95, 5/93.2, 100, 9.1, 8, 658, 503.1

(56) References Cited

U.S. PATENT DOCUMENTS 3,106,724 A * 10/1963 Kamp ..... 5/8
5,067,183 A * 11/1991 Urquiola ..... 5/2.1
5,194,482 A * 3/1993 Chundury et al. ..... 524/412
5,430,899 A * 7/1995 Chisholm ..... 5/95
5,747,129 A * 5/1998 Malofsky et al. ..... 5/93.1

* cited by examiner

*Primary Examiner*—Teri Pham Luu
*Assistant Examiner*—Fredrick Conley
(74) *Attorney, Agent, or Firm*—Ying-Kit Lau

(57) ABSTRACT

A retrofitting system designed to convert an adult-size bed into an infant/toddler bed is disclosed. The retrofitting system comprises first a template is being placed on a twin, full, queen, king-or larger size bed with an underside of the template fitted to an underside of a mattress. The system further comprises a number of interconnecting geometrical shape structures connected to the template on the bed. The template and geometrical shape structures can be disassembled and assembled (with or without accessories) into furniture (storage cabinet, diaper change table, chair, table, and others), toys (easel, activity center, car, slide, picnic table, wagon, snake, puzzle board and others) and other useful items, such as a security gate or storage cabinet for providing storage spaces for baby clothing, diapers, lotion, towels, baby powder, baby wipe etc.

23 Claims, 9 Drawing Sheets

FIG. 1
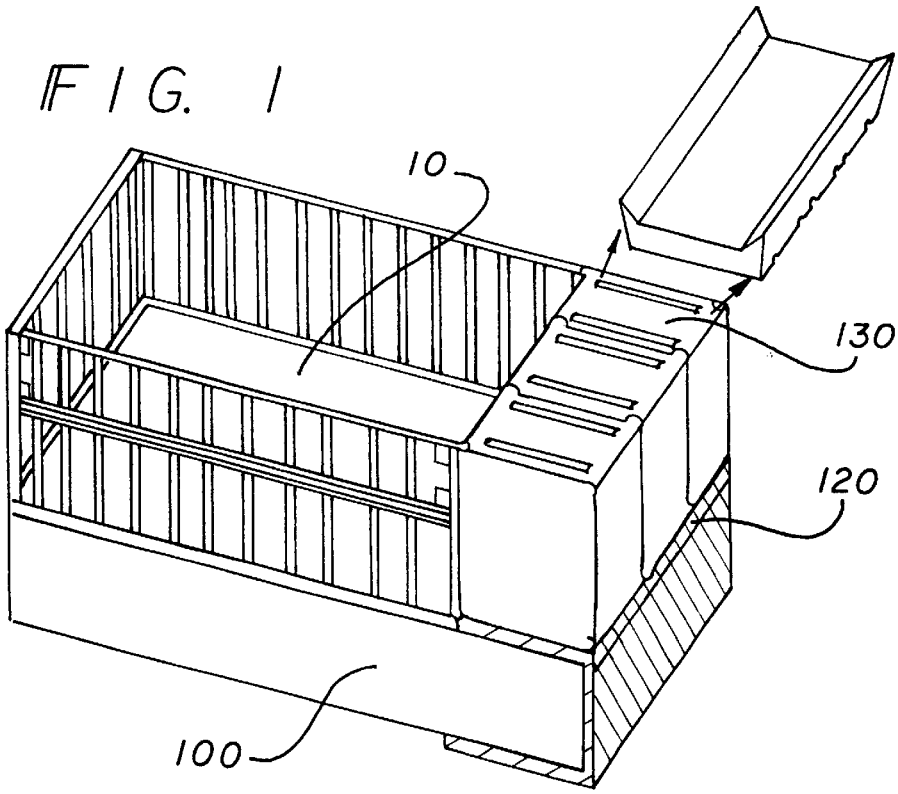
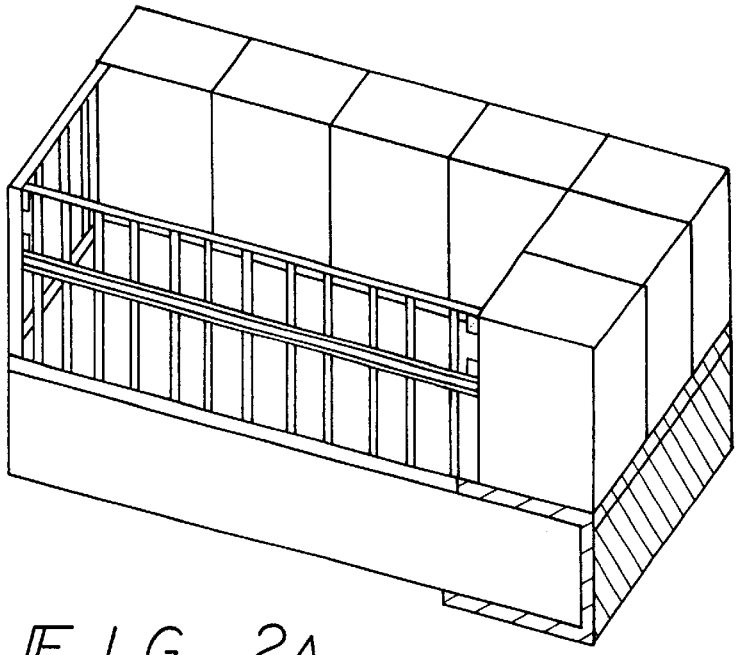
FIG. 2A

FIG. 4
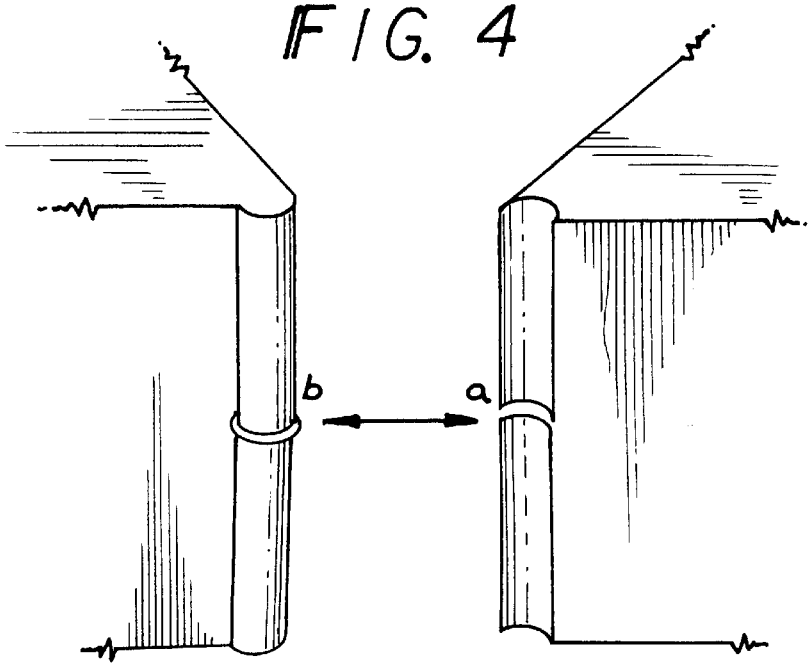
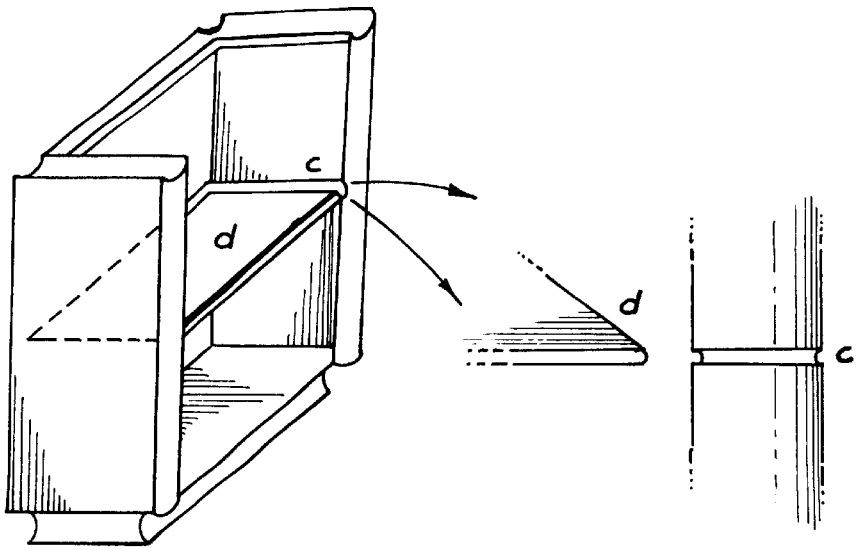
FIG. 5

FIG. 6
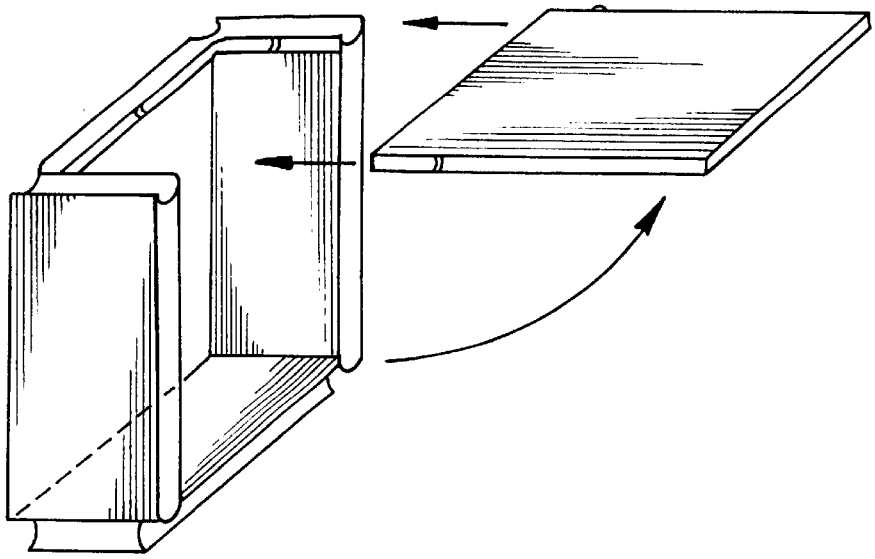
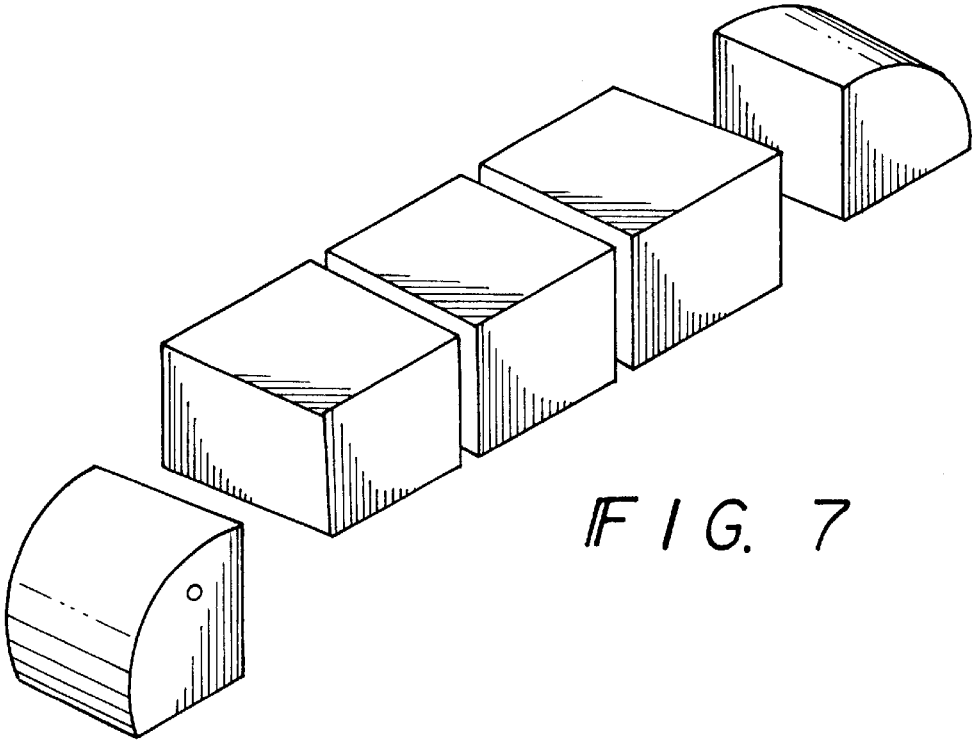
FIG. 7

ADULT-SIZED BED RETROFITTING SYSTEMS

RELATED U.S. APPLICATION DATA

Continuation-in-Part of application Ser. No. 09/241,958, issued as U.S. Pat. No. 6,134,726 Feb. 2, 1999.

BACKGROUND OF THE INVENTION

1. Field of the Invention

The present invention relates to a system designed to convert an adult-size bed into an infant/toddler bed. More specifically, the present invention is directed to converting a twin, full, queen, king or larger size-bed into an infant/toddler bed. The conversion system can also be disassembled and assembled (with or without accessories) into furniture (storage cabinet, diaper change table, chair, table, and others), toys (easel, activity center, car, slide, picnic table, wagon, snake, puzzle board and others) and other useful items, such as a security gate or storage cabinet for providing storage spaces for baby clothing, diapers, lotion, towels, baby powder, baby wipe etc. The system contains a template placed on a twin or larger-size adult bed with the underside of the template connected to the underside of a mattress of the bed. The system further contains a number of interconnecting geometrical shape structures connected to the template. The connection can be done by methods known to one skill in the art, such as a plate/channel connection system, lock-key connection system, and others.

2. Description of the Prior Art

There have been numerous designs for infant/toddler beds, children's furniture, storage boxes and toys. However, as the infant/toddler grows up, most of these children items have to be disposed of because they cannot be converted into something useful. There have been systems, such as the "bed for life" which converts a crib into a twin-size bed by using two of the four bed-pieces. However, two sets of mattress are needed for this conversion. Furthermore, the bed-pieces cannot be converted into furniture, toys or other useful items.

Earlier patent to Parsons (U.S. Pat. No. 2,412,005) illustrates a combined bed and crib arrangement, in which a typical sized adult bed portion can be fitted (possibly retrofitted) with a removable crib portion, the. crib portion being generally placed on the adult bed portion.

European Patent No. 581,231 A1 shows what appears to be a furniture assembly that can be placed on an existing bed structure for converting the bed structure for infant or toddler use. The assembly includes, among other structures, shelving and cabinet.

Wakefield's patent (U.S. Pat. No. 2,266,681), discloses a removable portable infant crib that can be placed on a conventionally sized bed.

The patent to Necowitz (U.S. Pat. No. 4,525,883), discloses a full size bed that can be converted to an infant's crib by raising a hidden vertical rail system.

The patent to Proano et al (U.S. Pat. No. 5,715,551), discloses convertible furniture that can be converted from an adult bed to an infant bed, and vice versa.

The patents to Soeder (U.S. Pat. No. 2,676,337) and Roman (U.S. Pat. No. 5,604,941), both disclose infant or toddler beds suited for removable placement on seats or sofas.

Melton's patent (U.S. Pat. No. 1,563,428), discloses an adult bed fitted with a slide-able hidden child's bed.

The patents to Power (U.S. Pat. No. 2,471,977) and Rist (U.S. Pat. No. 4,890,346) both disclose bed or crib partition devices that allow a bed or crib to be divided into two smaller beds.

The patent to Wolscht (U.S. Pat. No. 5,350,341), discloses an infant play enclosure equipped with several geometrical shapes.

The patent to Abrams (U.S. Pat. No. 2,646,576), discloses an adult size bed system having a template/member with side wall members connecting through an extension flange to an underside of a Mattress. Nowhere in Abrams discloses a number of interconnecting geometrical shape structures on at least one-side of the bed, connecting to the template.

The patent to Chisholm (U.S. Pat. No. 5,430,899), discloses a crib that contains a headboard, a footboard, and opposite side gates surrounding a horizontal mattress support platform adjustably attached to the headboard and footboard and being selectively placed at various levels.

None of the Patents discussed above discloses or teaches the invention of a retrofitting adult-size bed system converting an adult-size bed into an infant/toddler bed using one set of mattress. Moreover, none of the patents discloses or teaches an adult-size bed retrofitting system that can be converted into furniture, toys or other useful items. Thus, it would be desirable to provide a safe, convenient, economical, versatile, user and environmental-friendly retrofitting system for converting an adult size bed into an infant/toddler bed.

Accordingly, it is an object of the present invention to provide an adult size bed retrofitting system of the type set forth.

It is another object of the present invention to provide an adult size bed retrofitting system that can provide or convert to provide storage spaces for baby clothing, diapers, lotion, towels, baby powder, baby wipe etc. near a baby's bed for convenience.

It is another object of the present invention to provide an adult size bed retrofitting system that can provide or convert to provide versatile and useful devices, such as storage cabinet, diaper change table, chair, table, etc., near a baby's bed for convenience.

Another object of the present invention is to provide an adult size bed retrofitting system that can provide or convert to provide useful and versatile devices, such as toys including easel, activity center, car, slide. picnic table, wagon, snake, puzzle board etc. with or without accessories, such as wheels, head and tail of a snake etc. to reduce cost and space occupied by a bed and such centers and/or toys.

Another object of the present invention is to provide an adult size bed retrofitting system that can provide or convert to provide useful and versatile device, such as a security gate with accessories.

Other objects and advantage of the invention will become apparent from the following detailed disclosure.

SUMMARY OF THE INVENTION

In accordance with the present invention, an adult size bed retrofitting system is provided to eliminate the need for two sets of mattress to convert an adult size bed into an infant/toddler bed. The system contains by first placing a template on an adult-sized bed, an underside of the template is fitted under the underside side of a mattress of the bed. A number of interconnecting geometrical shape structures is then connected to the template. The template and the geometrical structures can be disassembled and/or assembled (with or without accessories) into furniture (storage cabinet, diaper change table, chair, table, and others), toys (easel, activity center, car, slide, picnic table, wagon, snake, puzzle board and others) and other useful items, such as a security gate or providing storage spaces for baby clothing, diapers, lotion, towels, baby powder, baby wipe etc.

The template can be constructed of a one-piece or several pieces combination. It is to be constructed of a safe, non-toxic and easy to fabricate material, such as thermoplastics, specialty plastics, thermosets, engineering plastics etc.

Thermoplastics include but not limited to: polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrile-butadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6, 6, nylon-6, nylon-6, 12, nylon-11, nylon 12, acetal resin, low and high density polypropylene (PP), high density polyethylene (HDPE), low density polyethylene (LDPE), polystyrene, ethylene-vinyl acetate, poly-vinyl-acetate, polyacrylic, etc., or a copolymer or a combination thereof.

Specialty plastics include but not limited to fluorocarbon polymers and infusible film products such as Kapton, Upilex polyimide film etc., a copolymer or a combination thereof. Thermosets include but not limited to phenolics, epoxies, urea-formaldehyde, silicones, etc., a copolymer or a combination thereof. Engineering plastics include but not limited to acetyl resins, polyamide, polyetherimides, polyesters, liquid crystal polymers, polycarbonate resins, poly-(phenylene ether) alloys, polysulfone resins, polyamideimide resins, etc., a copolymer or a combination thereof.

An extension from the underside of the template is connected to theunderside of a mattress of the bed. The template is then connected to a number of interconnecting geometrical shapes structures. The connection can be done by methods known to one skill in the art, such as a plate/channel, a lock-key connecting system or others. This template is vital in keeping the interconnecting geometrical shape structures stable and free from toppling-over by anyone pulling or leaning onto the structure. The geometrical shape structures can be of any shape, including but not limited to: a row of triangular surfaces with a rectangular back surface; a row of rectangular surfaces with a rectangular back surface; a row of hexagonal surfaces with a hexagonal back surface etc. The geometrical shape structures is also constructed of a safe, non-toxic and easy to fabricate material, such as but not limited to thermoplastics, specialty plastics, thermosets, engineering plastics etc.

Thermoplastics include but not limited to: polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrile-butadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6, 6, nylon-6, nylon-6,12, nylon-11, nylon 12, acetal resin, polypropylene (PP), high density polyethylene (HDPE), low density polyethylene (LDPE), polystyrene, ethylene-vinyl acetate, poly-vinyl-acetate, polyacrylic, etc., or a copolymer or a combination thereof.

Specialty plastics include but not limited to fluorocarbon polymers, infusible film products such as Kapton and Upilex polyimide film, etc., a copolymer or a combination thereof. Thermosets include but not limited to phenolics, epoxies, urea-formaldehyde and silicones, etc., a copolymer or a combination thereof. Engineering plastics include but not limited to acetyl resins, polyamide, polyetherimides, polyesters, liquid crystal polymers, poly-carbonate resins, poly-(phenylene ether) alloys, polysulfone resins, polyamideimide resins, etc., a copolymer or a combination thereof. These structures are interconnected by methods familiar to one skill in the art. The preferred embodiment includes but not limited to having a geometrical shape structure with at least two surfaces. One surface comprises of a male connecting plates and the other a channel. This way the plate of one structure is connected to the channel of another structure forming the interconnecting geometrical shape structures.

BRIEF DESCRIPTION OF THE DRAWING

The novel features which are believed to be characteristic of the invention are set forth with particularity in the appended claims. The invention itself, however, both as to its organization and method of construction and operation, may best be understood by reference to the following description, taken in connection with the accompanying drawing in which:

FIG. 1 is a perspective side view of a retrofitting system on one side of an adult-size bed;

FIG. 2A is a perspective side view of a retrofitting system on two sides of an adult-size bed;

FIG. 4 is a perspective side-view of a close-up of the plate/channel connecting system;

FIG. 5 is a geometrical shape structure in the form of a converted chair;

FIG. 6 is a geometrical shape structure in the form of a converted table;

FIG. 7 shows the retrofitting system with accessories to form a snake;

DESCRIPTION OF THE PREFERRED EMBODIMENT

Figure 2B:
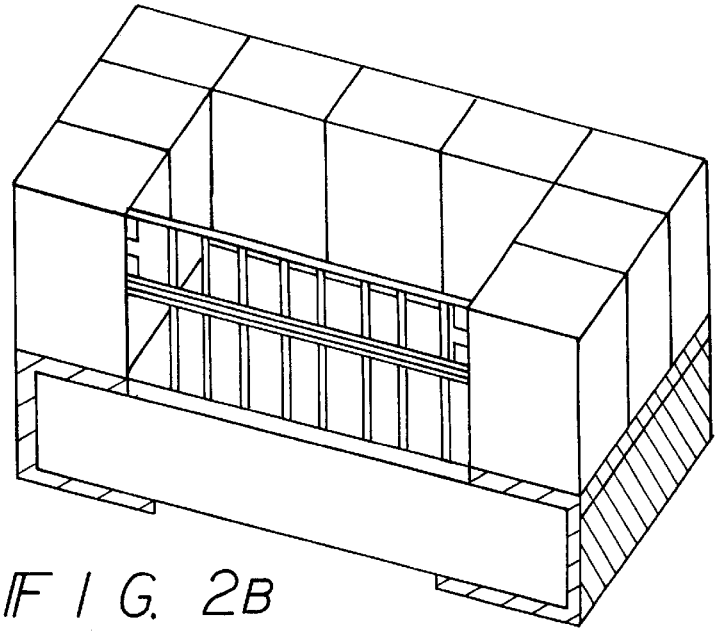
FIG. 2B is a perspective side view of a retrofitting system on three sides of an adult-size bed.
Figure 3:
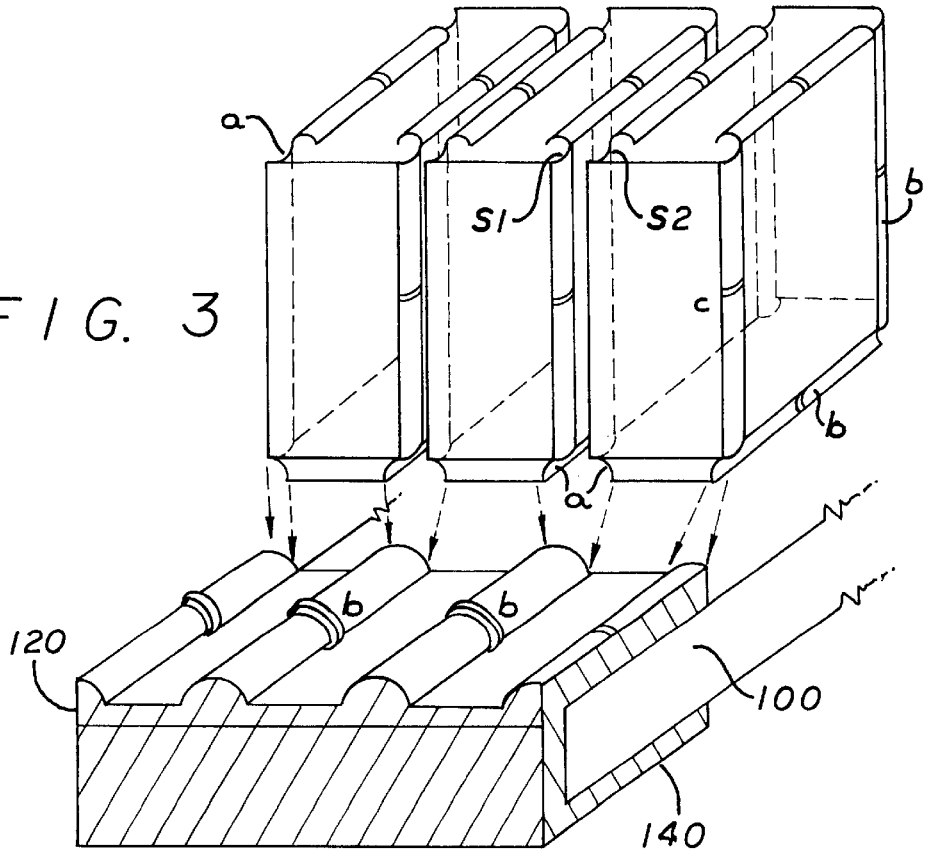
FIG. 3 is a side view of a rectangular shaped retrofitting system showing the plate and channel connecting system and part of the template for the retrofitting system.

A regular twin-size bed 10 has the dimensions of about 75 (length)×39 (width)×8 (height) inches. A regular infant/toddler size bed has a dimension of about 52×28×6 inches. FIG. 1, FIGS. 2A and 2B show a retrofitting systems for one, two and three sides of an adult-size bed respectively. From FIGS. 1 and 2A and 2B, a retrofitting system 110 comprises a template 120 being first placed on a twin-size or larger size (full, queen, king-size etc) mattress 100. This template is to provide anchoring and stability to the interconnecting geometrical structures. In FIGS. 1, 2A and 2B, the geometrical shape structures are in the form of a rectangular face structure 130. For an adult-size bed one side retrofitting system, part of the template 120 is shown in details in FIG. 3. For a twin-size bed, the dimension of one of the template is about 26×39×9 inches. The template 120 is of a one-piece construction but it can be of several pieces using methods common to one skill in the art, such as the plate/channel method discussed earlier for connection. An underside 140 of the template is tucked under the mattress, thus preventing the geometrical structure from rolling over when a baby or someone is pulling or leaning onto the structure 130. The upper-side of the template 120 contains plates/channels that are to be connected to the channels/plates of the interconnecting geometrical structures 130 (see FIG.3). One side SI of the interconnecting geometrical shape structure has a plate to which it is connected to a channel on one side S2 of another geometrical structure. To provide additional stability and anchoring strength, an anchoring concave/convex surfaces are used in the channel/plate connecting system. (see FIG. 4). This prevents the plate from accidentally sliding out from the channel once it is in place. The rectangular geometrical shape structure is used to provide for storage spaces for baby clothing, diapers, lotion, towels, baby powder, baby wipe, toys and other accessories for the baby.

Figure 2C:
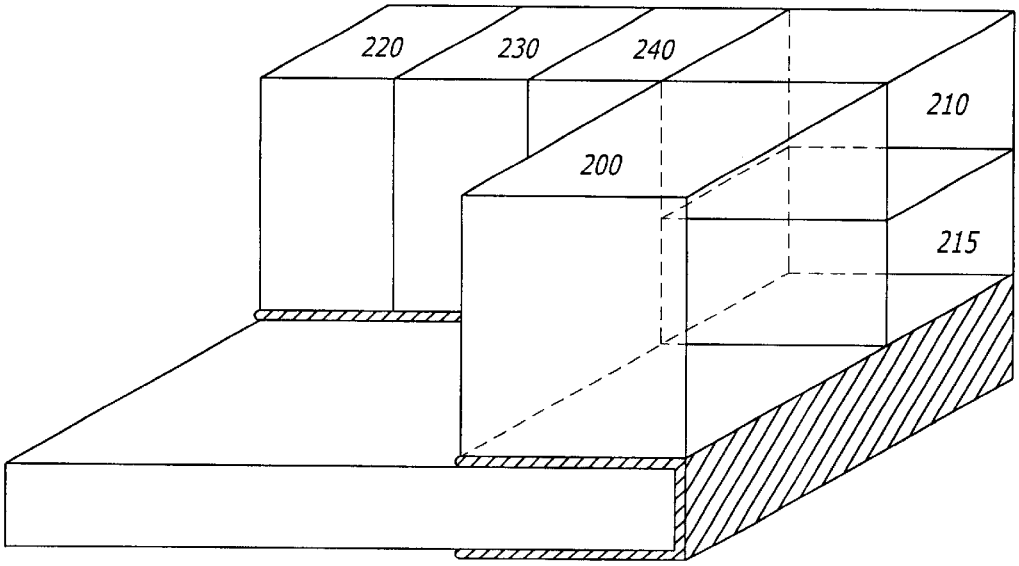
FIG. 2C is a perspective side view of another embodiment of a retrofitting system on two sides of an adult-size bed that is converted into cubicles, cabinets or storage units.
Figure 2D:
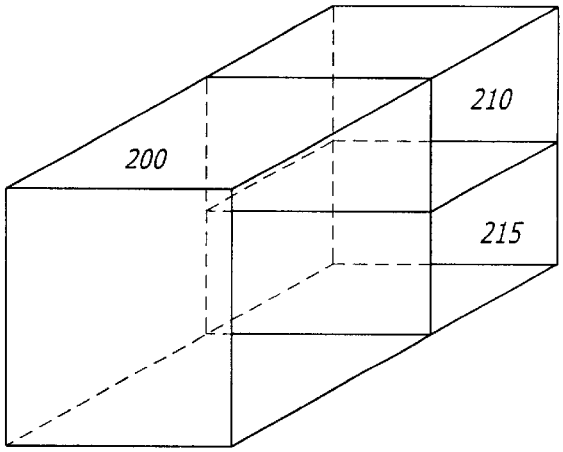
FIG. 2D is a perspective side view of a storage unit converted from a retrofitting system of FIG. 2C.
Figure 2E:
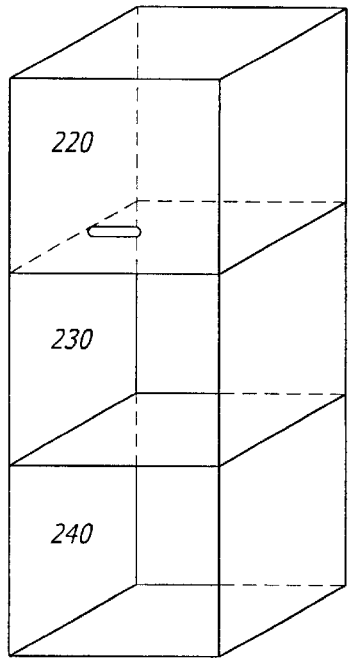
FIG. 2E is a perspective side view of a cabinet converted from a retrofitting system of FIG. 2C.
Figure 3A:
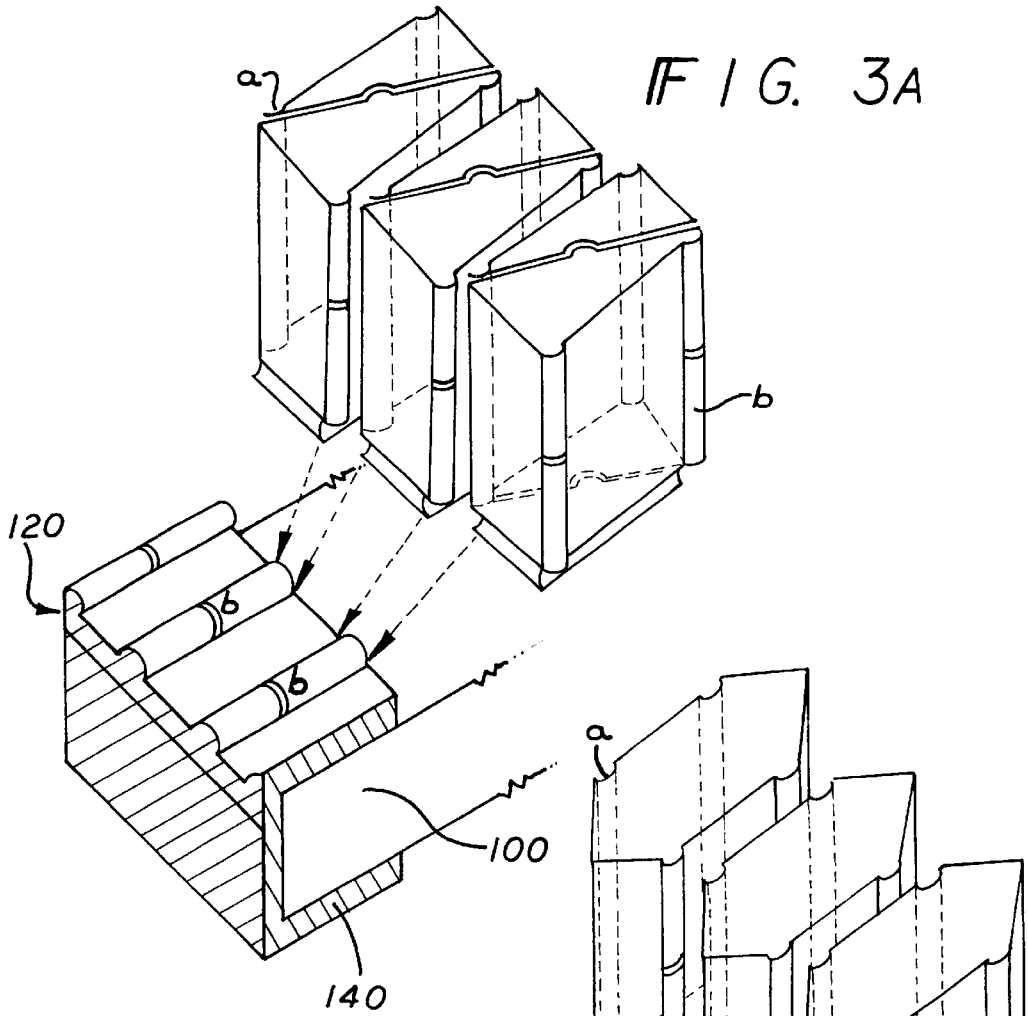
FIG. 3A is a perspective side view of a row of triangular surfaces with a rectangular back surface of a retrofitting system.
Figure 3B:
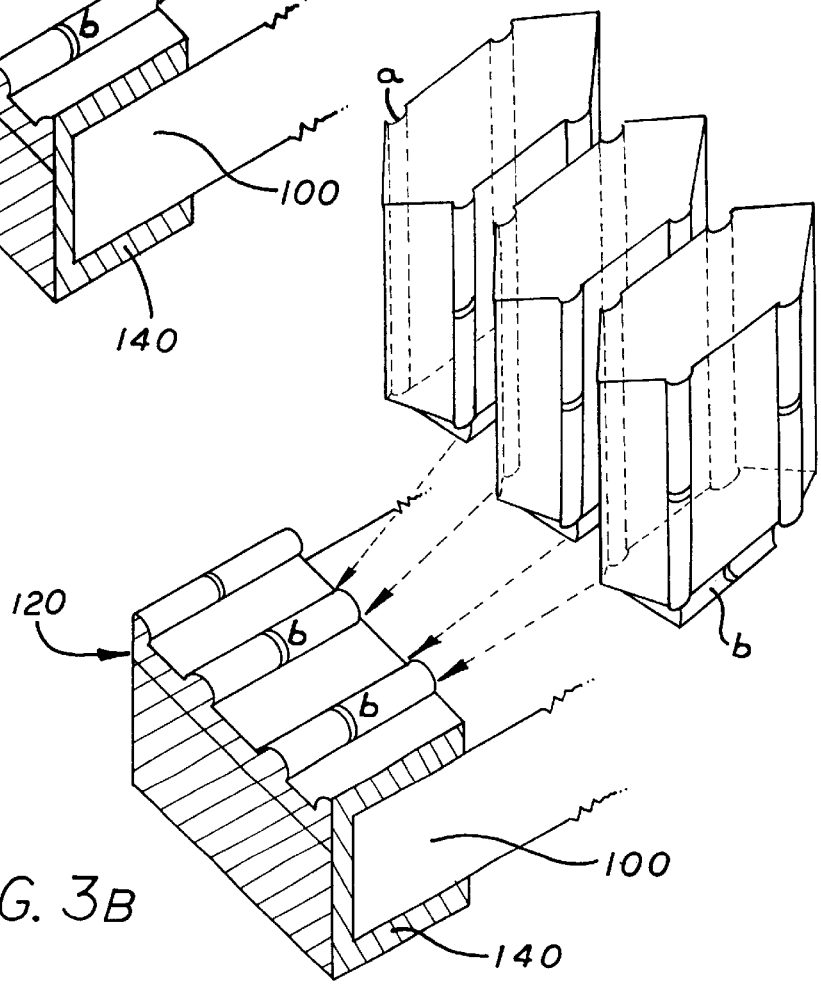
FIG. 3B is a perspective side view of a row of hexagonal surfaces with a hexagonal back surface of a retrofitting system.

FIG. 2C shows an alternate embodiment of a retrofitting system 110 on two sides of an adult size bed with components 200, 210, 215, 220, 230, and 240 that is converted into cubicles, cabinets (such as 220, 230, and 240, see FIG. 2E) or storage units (such as 200, 210, and 215, see FIG. 2D).

Alternatively, as shown in FIG. 5 and FIG. 6, one of the rectangular shape structures is converted into a chair and another into a table. To form a chair, the geometrical shape structure has its top removed and placed is in the center channel providing a sitting place as a chair. To form a table, a side panel of the geometrical shape structure can be removed and connect to its top forming a table.

As shown in FIG. 7, a snake toy (250) is formed from the retrofitting system 110 with accessories 260 and 270 forming the head and tail of the snake.

Also, a changing table is added to the top portion of the geometrical structures by accessories 280 having sloping sides that cushion and prevent baby from falling, with plates/channels on the underside of the changer connecting to the top portion of the geometrical structures (see FIG. 1).

Figure 8:
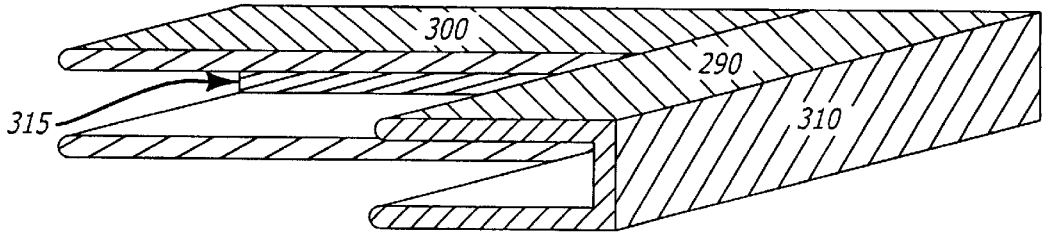
FIG. 8 shows embodiment of a template of a retrofitting system
Figure 8A:
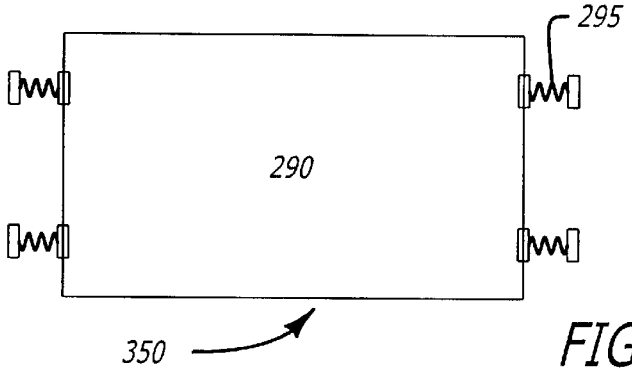
FIG. 8A shows the template of FIG. 8 that is converted into a security gate (with accessories)
Figure 8B:
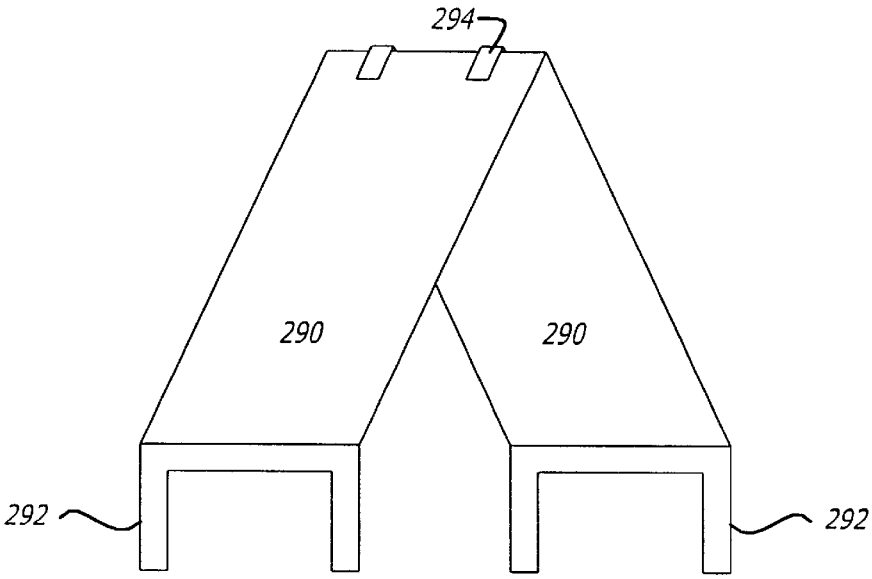
FIG. 8B shows embodiment of a template of a retrofitting system that is converted into an easel (with accessories)

As shown in FIG. 8, embodiment of a template of a retrofitting system contains pieces 290 (2 pieces), 300 (2 pieces), 310 (1 piece), 315 (1 piece) (see FIG. 8A). The template of the retrofitting system is converted into a security gate 350 with accessories-295 (screws and springs) and component 290. Two 290 pieces with accessories 292 (-attachment legs) and 294 (-clip springs) form an easel (see FIG. 8B).

Figure 9:
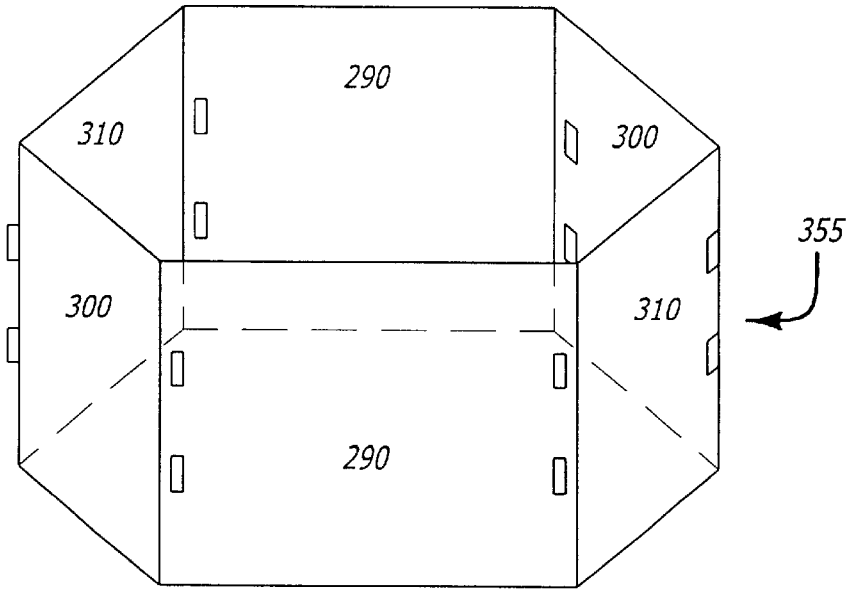
FIG. 9 shows embodiment of a template of a retrofitting system that is converted into an activity center.

In FIG. 9, an activity center 355 is formed from a template (as shown in FIG. 8) of a retrofitting system with accessories (1-piece of 310).

Figure 10:
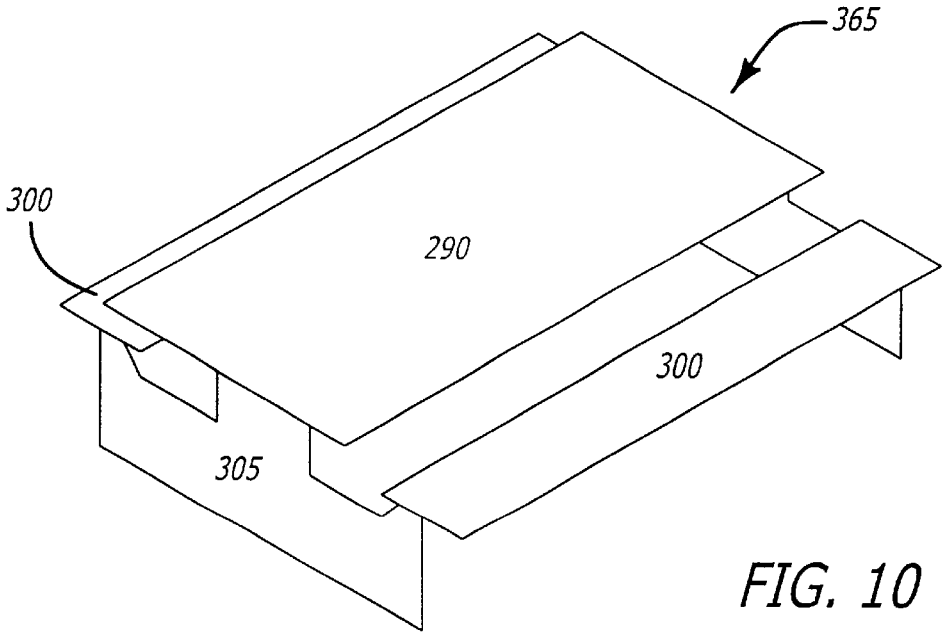
FIG. 10 shows embodiment of a template of a retrofitting system that is converted into a picnic table.

In FIG. 10, a picnic table 365 is formed from a template of a retrofitting system using components 290 and 300 (2-pieces), together with accessories 305-(two attachment legs).

Figure 11A:
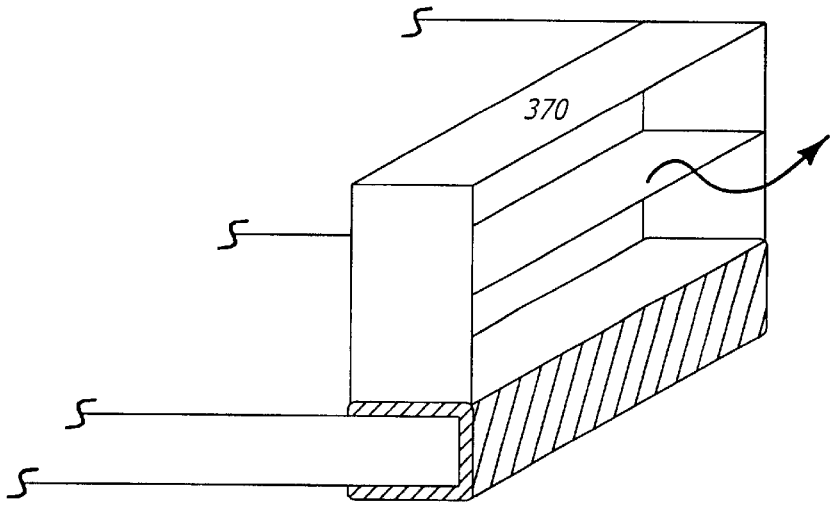
FIG. 11A shows another retrofitting system that is converted into a wagon with accessories.
Figure 11B:
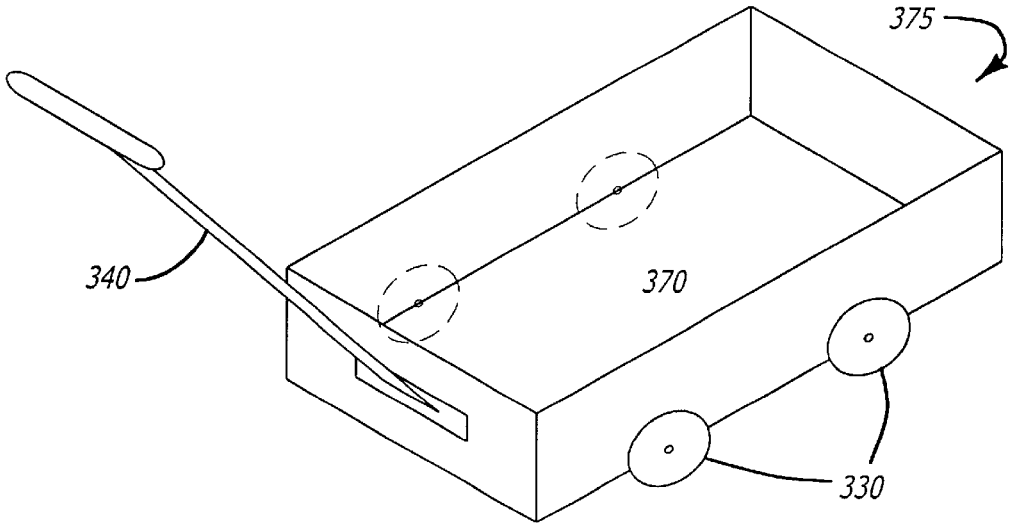
FIG. 11B shows a wagon converted from a retrofitting system of FIG. 11A.

In FIG. 11B, a wagon 375 is formed from a retrofitting system having pieces of 370 (see FIG. 11A) together with wheels-330, and handle-340.

The geometrical shape structure is constructed of a safe, non-toxic, easy to fabricate material, such as but not limited to thermoplastics, specialty plastics, thermosets, engineering plastics etc.

Thermoplastics include but not limited to: polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrile-butadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6,6, nylon-6, nylon-6, 12, nylon-11, nylon 12, acetal resin, polypropylene (PP), high density polyethylene (HDPE), low density polyethylene (LDPE), polystyrene, ethylene-vinyl acetate, polyvinyl-acetate, polyacrylic, etc., or a copolymer or a combination thereof.

Specialty plastics include but not limited to fluorocarbon polymers, infusible film products such as Kapton and Upilex polyimide film, etc., a copolymer or a combination thereof. Thermosets include but not limited to phenolics, epoxies, urea-formaldehyde and silicones, etc., a co-polymer or a combination thereof. Engineering plastics include but not limited to acetyl resins, polyamide, polyetherimides, polyesters, liquid crystal polymers, polycarbonate resins, poly-(phenylene ether) alloys, polysulfone resins, polyamideimide resins, etc., a copolymer or a combination thereof.

I claim:

1. An adult size bed retrofitting system (110) comprises an adult-sized mattress (100), a non-self supporting template (120) placed on an adult size bed with a portion of said template being placed on top of said mattress (top template portion), the template is fittingly supported by the mattress and a number of connecting geometrical shape structures (130) on at least one-side of the bed connecting to said top template portion, said template further has an extension connected to an underside of a mattress (lower template portion) to provide stability in preventing the system from toppling over, said geometrical shape interconnecting structure further comprises more than one individual structure on each side of the bed to provide storage spaces for baby items.

2. An adult size bed retrofitting system of claim 1 with the template further fabricated from a thermoplastic material.

3. An adult size bed retrofitting system of claim 2 with the thermoplastic material further comprises polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrile-butadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6, 6, nylon-6, nylon-6,12, nylon-11, nylon 12, acetal resin, polypropylene (PP), high density polyethylene (HDPE), low density polyethylene (LDPE), polystyrene, ethylene-vinyl acetate, polyvinyl-acetate, polyacrylic, a copolymer or a combination thereof.

4. An adult size bed retrofitting system of claim 1 with the template further fabricated from a specialty plastics material.

5. An adult size bed retrofitting system of claim 4 with the specialty plastics material further comprises fluorocarbon polymers, infusible film products, a copolymer or a combination thereof.

6. An adult bed retrofitting system of claim 1 with the template further fabricated from a thermosets material.

7. An adult size bed retrofitting system of claim 6 with the thermosets material further comprise, phenolics, epoxies, urea-formaldehyde, silicones, a copolymer or a combination thereof.

8. An adult bed retrofitting system of claim 1 with the template, further fabricated from an engineering plastics material.

9. An adult size bed retrofitting system of claim 8 with the engineering plastics material further comprises acetyl resins, polyamide, polyetherimides, polyesters, liquid crystal polymers, polycarbonate resins, poly(phenylene ether) alloys, polysulfone resins, polyamideimide resins, a copolymer or a combination thereof.

10. An adult size bed retrofitting system of claim 1 with the connecting geometrical shape structures further comprises a row of triangular surfaces with a rectangular back surface, a row of rectangular surfaces with a rectangular back surface or a row of hexagonal surfaces with a hexagonal back surface.

11. An adult size bed system of claim 1 with said connecting geometrical shape structures further comprises a row of rectangular surface with a rectangular back surface.

12. An adult size bed retrofitting system of claim 1 with said connecting geometrical shape structures further comprises a row of hexagonal surfaces with a hexagonal back surface.

13. An adult size bed retrofitting system of claim 1 further comprises said geometrical shape structures connecting to the template by a plate/channel system.

14. An adult size bed retrofitting system of claim 1 further comprises said geometrical shape structures connecting to the template by a lock/key system.

15. An adult size bed retrofitting system of claim 1 further comprises said geometrical structures that are converted into cubicles, cabinets or storage units.

16. An adult size bed retrofitting system of claim 1 further comprises said geometrical structure that is converted into a chair.

17. An adult size bed retrofitting system of claim 1 further comprises said geometrical structure that is converted into a table.

18. An adult size bed retrofitting system of claim 1 further comprises said geometrical structures that are converted into a snake with accessories of a head and a tail of a snake.

19. An adult size bed retrofitting system of claim 1 further comprises said template that is converted into a security gate with screws and springs.

20. An adult size bed retrofitting system of claim 1 further comprises said template that is converted into an easel with attachment legs and clip springs.

21. An adult size bed retrofitting system of claim 1 further comprises said template that is converted into an activity center.

22. An adult size bed retrofitting system of claim 1 further comprises said template that is converted into a picnic table with two attachment legs.

23. An adult size bed retrofitting system of claim 1 further comprises said geometrical shape structures that are converted into a wagon with handle and wheels.

* * * * *